United States Patent [19]

Lucas

[11] 4,025,361

[45] May 24, 1977

[54] REMOVAL OF CERAMIC INVESTMENT SHELL MOLD FROM METAL CASTING

[75] Inventor: Joseph G. Lucas, Trumbull, Conn.

[73] Assignee: Avco Corporation, Stratford, Conn.

[22] Filed: Sept. 4, 1975

[21] Appl. No.: 610,494

[52] U.S. Cl. ..... 134/28; 134/41; 164/131

[51] Int. Cl.[2] ..... B22D 29/00

[58] Field of Search ..... 164/131, 25, 26; 252/142; 134/3, 28, 41

[56] References Cited

UNITED STATES PATENTS

| | | | |
|---|---|---|---|
| 2,605,775 | 8/1952 | Kientz | 134/3 |
| 2,666,001 | 1/1954 | Marshall | 134/3 UX |
| 2,705,192 | 3/1955 | Faust et al. | 252/142 X |
| 3,622,391 | 11/1971 | Baldi | 252/142 X |

FOREIGN PATENTS OR APPLICATIONS

| | | | |
|---|---|---|---|
| 214,757 | 5/1968 | U.S.S.R. | 164/131 |

*Primary Examiner*—Robert D. Baldwin
*Attorney, Agent, or Firm*—Charles M. Hogan; Irwin P. Garfinkle; Lawrence I. Field

[57] ABSTRACT

Ceramic shell molds are removed from cast turbine blades by contacting the shell mold with a concentrated solution of HF whereby the binder of the shell is destroyed and the shell material falls away from the metal casting.

6 Claims, No Drawings

REMOVAL OF CERAMIC INVESTMENT SHELL MOLD FROM METAL CASTING

This invention relates to the removal of ceramic shell molds from metal articles cast therein.

One of the more recent developments in the precision casting of metal articles such as turbine blades is the use of shell molds. The usual process of casting comprises the following sequence of steps with or without variations thereof:

1. Preparing a disposable pattern of wax or other suitable material corresponding to the shape of the article to be cast in metal;
2. Forming ceramic shell mold on the surface of the pattern said shell comprising at least one refractory material and a binder for the refractory material;
3. Eliminating the disposable pattern by any suitable known technique (heating, dissolution, etc.);
4. Firing the shell mold to impart strength to the shell mold;
5. Investing the shell mold in a support such as plaster or sand or other suitable back-up material;
6. Casting the metal in the cavity of the shell mold; and
7. Removing the shell mold from the metal casting.

Processes of this general nature are described in each of the following United States Patents, the disclosures of which are intended to be incorporated herein by this reference:

| Patent No. | Inventor | Issued |
|---|---|---|
| 2,961,751 | Operhall | November 29, 1960 |
| 3,196,506 | Operhall | July 27, 1965 |
| 3,196,505 | Moren | July 27, 1965 |
| 3,239,897 | Lirones | March 15, 1966 |

and many others of a similar nature.

The present invention is directed to an improvement in the last step of the above process sequence. When the metal cast is a nickel-base or cobalt-base superalloy or a stainless steel it has been found desirable to provide a face coating on the shell mold, of a special composition for the purpose of providing a fine grain to the metal being cast. Such a face coat tends to adhere tenaciously to the metal casting and interferes with removal of the shell mold from the cast article. One common procedure for removing the shell mold from the casting has been to detach the shell by means of a pneumatic hammer or high pressure water streams and thereafter to sand blast the casting to remove foreign non-metallic material adhering to the surface of the casting. Such procedures may damage thin casting sections and often require extended and repeated applications to clean the casting.

The casting of turbine wheel and blade configurations of superalloys of the type noted above presents problems not encountered in the casting of metals such as cast iron, copper, and aluminum and it has been necessary to develop specific shell compositions in order to overcome these problems. Specifically, fine grain size is a very important consideration and nucleating agents are incorporated in the first coat of the shell manufacturing process. This first coat is that which determines the surface quality of the casting. It is normally very tenacious and requires considerable sand blasting to remove it from the cast superalloy article.

Prior to the present invention, the removal of shell molds from superalloy castings has been effected primarily by mechanical means such as hammering.

The present invention is directed to an improved procedure whereby the time spent in removing the shell mold from the superalloy casting is greatly reduced and the procedure is appreciably simplified, and possible damage to thin sections of cast metal is eliminated or substantially diminished.

The removal of the shell mold from the cast article by the process of this invention is effected by immersion of the shell mold containing the metal casting into a bath of concentrated hydrofluoric acid (e.g. 48–70% HF), which need not be heated, for a period of about 15 to 30 minutes. As a result of this immersion, the siliceous binder for the refractory of the shell mold is dissolved. On removal of the article from the acid bath, it is found that the shell mold material crumbles easily and breaks away from the metal casting without recourse to hammering or other mechanical means. If any areas do not clean sufficiently, the immersion in the acid is repeated.

The final clean up of the article is accomplished by immersion in a nitric acid, hydrofluoric acid, hydrochloric acid, water solution for a few moments followed by a water rinse and then drying after which the article is blasted with a fine abrasive.

The above described treatment has been found to be effective for cleaning castings of stainless steel alloys, C-450 and Ni Base Alloy 718 without intergranular attack, and for removing shell molds comprising a mixture of zircon, alumina and colloidal silica bonded with an alkali metal silicate and having a black cobalt oxide nucleant as part of face coat of the ceramic shell.

Metals to which the invention has been applied are superalloys of the types described in United States Patent 3,619,182 issued November 9, 1971 to Bieber et al., and improvements thereon and to stainless steels with up to 35% Cr.

The following is an example of the practice of the invention and is not intended to limit the same.

After preparing a shell mold in the usual way, a nickel or cobalt base alloy turbine blade was cast therein. After the outermost portions of the shell mold had been knocked off or otherwise separated from the casting the remainder of the shell mold was removed from the casting as follows:

1. Immerse the integrally cast turbine wheel with thin blades and adherent shell mold material in concentrated hydrofluoric acid for one to two hours to destroy the siliceous binder of the ceramic shell;
2. Rinse in cold water and brush away the disintegrating ceramic shell;
3. Repeat above procedure if ceramic shell is still intact in places;
4. Immerse the part in a water solution containing nitric acid and hydrofluoric acid (1 vol: 2 vol: 2 vol) for several minutes to clean the shell mold from the casting by dissolving the very adherent cobalt oxide nucleant from the part;
5. Rinse in cold water;
6. Liquid hone the surfaces of the cast metal article to give a clean metallic finish; and
7. Rinse in cold water, then hot water and dry with air blast.

A particularly preferred cleaning composition also includes a small amount of HCl. One such formulation used in the practice of this invention consisted of the following:

Water — 1 Vol.
42° $HNO_3$ — 2 Vol.
48–70% HF — 2 Vol.
36% HCl — 0.02% by volume of mixed acids solution.

Having now described preferred embodiments of the invention in accordance with the patent statutes it is not intended that it be limited except as required by the appended claims.

I claim:

1. In a process for cleaning metal articles consisting of a metal alloy selected from the group consisting of nickel-base superalloys, cobalt base superalloys and stainless steels containing up to 35% Cr and which have been cast in a ceramic shell mold comprising at least one refractory oxide material bonded by an inorganic silicate and including a nucleant as part of the face coating, the improvement which comprises:

immersing the cast metal article, while at least partially embedded in the ceramic shell mold, in a concentrated solution of HF for a time sufficient to effect at least partial disintegration of said shell mold by the dissolving action of said HF solution on said inorganic silicate binder, thereby facilitating partial removal of said ceramic shell mold from said cast metal article; and thereafter immersing the article in a solution of HF and $HNO_3$ in water to dissolve said nucleant and complete the removal of said ceramic shell.

2. The process of claim 1 including in addition rinsing the article after immersion in HF to separate the disintegrating shell mold before the further immerson.

3. The process of claim 1 wherein said solution of HF and $HNO_3$ in water also contains a small amount of HCl.

4. The process of claim 1 wherein said solution consists essentially of $H_2O$, $HNO_3$ and HF in the proportions 1:2:1 by volume based on 42° $HNO_3$ and 48–70% HF.

5. The process of claim 4 wherein the solution contains in addition a small amount of HCl.

6. The process of claim 1 including as a further step, liquid honing the cast article after said immersion in a solution of HF and $HNO_3$ in water.

* * * * *

UNITED STATES PATENT OFFICE

CERTIFICATE OF CORRECTION

PATENT NO. : 4,025,361

DATED : May 24, 1977

INVENTOR(S) : Joseph G. Lucas

It is certified that error appears in the above-identified patent and that said Letters Patent are hereby corrected as shown below:

Column 4, line 16 (Claim 4, line 3), "1:2:1" should read -- 1:2:2 -- .

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*